United States Patent [19]

Williams

[11] Patent Number: 4,667,351

[45] Date of Patent: May 26, 1987

[54] SPRAY FLUSHING ATTACHMENT FOR VEHICLE HOLDING TANKS AND THE COMBINATION THEREOF

[76] Inventor: Frank M. Williams, 6802 Meridian Ave. N., Puyallup, Wash. 98371

[21] Appl. No.: 726,148

[22] Filed: Apr. 23, 1985

Related U.S. Application Data

[63] Continuation-in-part of Ser. No. 457,501, May 11, 1983, abandoned.

[51] Int. Cl.[4] ..... B08B 9/08; B05B 1/26

[52] U.S. Cl. ..... 4/323; 134/166 R; 239/282; 239/521

[58] Field of Search ..... 4/321-323, 4/458, 316, 317, 300; 134/166 R, 177, 198; 239/282, 521, 523, 589, 592, 593, 283

[56] References Cited

U.S. PATENT DOCUMENTS

| | | | |
|---|---|---|---|
| 957,933 | 5/1910 | Clarke . | |
| 1,085,850 | 2/1914 | Cronk . | |
| 1,112,507 | 10/1914 | West . | |
| 1,155,550 | 10/1915 | Clarke . | |
| 2,425,918 | 8/1947 | Brown | 239/282 |
| 2,817,091 | 5/1957 | Painter | 4/1 |
| 2,864,406 | 12/1958 | Schewel | 239/521 X |
| 2,921,488 | 1/1960 | Davis | 239/521 X |
| 3,342,337 | 9/1967 | Reid . | |
| 3,501,778 | 3/1970 | Minniear et al. | 4/10 |
| 3,566,417 | 3/1971 | Gross | 4/77 |
| 3,597,768 | 8/1971 | Wofford | 4/10 |
| 3,760,430 | 9/1973 | Brenden | 4/114 |
| 3,780,757 | 12/1973 | Jordon | 4/321 X |
| 3,897,599 | 8/1975 | Artzer | 4/323 |
| 4,028,746 | 6/1977 | Huck | 4/10 |
| 4,052,004 | 10/1977 | Martin et al. | 239/282 X |

OTHER PUBLICATIONS

Information sheet for "No-Fuss Flush", Harry Dye, Napa, Calif. 94558.

*Primary Examiner*—Andres Kashnikow
*Attorney, Agent, or Firm*—Roy E. Mattern, Jr.

[57] ABSTRACT

A spray flushing attachment for vehicle holding tanks, installed during initial manufacture or subsequently installed, is used to effectively and thoroughly clean out a vehicle holding tank, during the emptying of the holding tank. It is positioned in part through a hole in a holding tank end wall and secured from the outside, at a location opposite to the other end wall, in which a standard holding tank drain has been factory installed. When cleaning water under pressure is supplied through a hose to standard PVC pipe fittings attached to the spray flushing attachment, its interior horizontally diverging spray nozzle pointed toward the drain creates a wide spray across the bottom of this vehicle holding tank, which effectively cleans out the tank so no residue remains. The pressurized water flowing through the nozzle expands laterally while confined between widening arcuate nozzle sides which are covered above and left open below, and the cover terminates at a horizontal level matching the bottom of the nozzle entry orifice. The flushing attachment at its outside end has a projecting portion, matching standard available one half inch diameter PVC pipe fittings. In between these ends is an integral circular hollow housing which fits in a hole especially made in the holding tank. Adjacent to this housing is an integral external flange, inclusive of an O ring, which is secured to the holding tank exterior to firmly position all the portions of the entire spray flushing attachment.

20 Claims, 9 Drawing Figures

SPRAY FLUSHING ATTACHMENT FOR VEHICLE HOLDING TANKS AND THE COMBINATION THEREOF

CROSS REFERENCE

This is a continuation in part application based on the original application Ser. No. 457,501 filed 5/11/83 by Frank M. Williams for a "Spray Flushing Attachment for Vehicle Holding Tanks and the Combination Therof", now abandoned, and all information contained therein is by reference incorporated herein.

BACKGROUND OF THE INVENTION

With respect to the collection of human wastes in holding tanks of vehicles, earlier in conjunction with trains:

In 1914, Harrison Cronk in his U.S. Pat. No. 1,085,850, disclosing a railroad closet tank, installed a nozzle high at one end of the tank to admit steam, when flusing out the contents of the tank down through a drain located near the center of the closet tank;

In 1914, William West in his U.S. Pat. No. 1,112,507, disclosing a water closet for railway carriages, provided a flushing water circular pipe opening at a low location at a holding tank end, opposite to the other end which in turn was nearby a discharge opening in a downwardly sloping tank bottom; and In 1915, Anna Clarke in her U.S. Pat. No. 1,155,550, disclosing a sewage system for railway cars, arranged for a flushing water circular pipe opening at a high location at a holding tank end opposite to the other end having a low location discharge circular pipe opening.

Subsequently through the years other types of holding tanks were installed in other vehicles, such as those disclosed in U.S. Pat. Nos. 2,817,091 of 1957 regarding a mobile sanitary trailer; 3,501,778 of 1970, disclosing a high centrally located spray tube in a tank of a self contained sewerage system; 3,556,417 of 1971 illustrating a combination toilet and holding tank; 3,597,768 of 1971 describing a holding tank for a mobile vehicle; 3,760,430 of 1973 disclosing an adapter apparatus for a portable sewage disposal system; 3,897,599 of 1975 illustrating and describing a holding tank, which upon being emptied, employs a self contained internal flailing tube discharging rinsing water under high pressure at changing and multiple locations to clean out the interior of the holding tank; and 4,028, 746 of 1977 disclosing a portable toilet utilizing a high entry opening for flushing water used periodically to clean out the holding tank.

Then it is believed, subsequent to the filing of the original application, of which this application is a continuation in part application, a flushing unit is now offered on the market under the trademark "No-Fuss Flush", which sprays water in multiple directions from spaced holes formed in the exterior of a hollow cylinder which is positioned inside a vehicle holding tank.

All these representative disclosures of patents indicate the extensive development of holding tanks over a number of years. Yet today vehicles, such as travel trailers and motor homes, which have holding tanks are still not equipped with adequate flushing attachments to be used, when the entire holding tank must periodically be drained and completely cleaned out. Mr. Richard F. Artzer in his U.S. Pat. No. 3,897,599 did indicate the need for more extensive cleaning by employing his flailing tube. Also the "No-Fuss Flush" flushing unit indicates this need. However, it is still believed there remains a need for insuring a holding tank that can be sufficiently cleaned out, without following a practice, still commonly undertaken, of extending a garden type hose through the living spaces of a trailer or motor home to the bathroom and then using water supplied via the hose to completely rinse out the holding tank. There remained a need to be able to secure a garden hose directly to a holding tank attachment lcoated outside the interior of a motor home or travel trailer, and when the cleaning water was turned on for a short while, as the tank drain was opened, that thereafter the interior of the holding tank would be sufficiently cleaned out to remove the debris and all sources of odor.

SUMMARY OF THE INVENTION

For very convenient inclusion at a manufacturing time or later by dealers or owners, a spray flushing attachment for a vehicle holding tank is available to sufficiently clean out a holding tank, while only running cleaning water for a short time, commencing when the tank drain is opened. This attachment is installed preferably opposite the regular drain of the holding tank. Only one hole is made in the holding tank, just a short distance above the bottom, to receive the integral circular hollow housing of this spray flushing attachment. An integral outside flange adjacent to this housing with an O ring seal fits securely and sealably against the tank exterior for securement by screws for easy installation, thereby completing the installation. On the exterior of the holding tank, the integral outside extending PVC pipe like portion of the flushing attachment is ready to receive other standard PVC pipe fittings, via cement to eventually receive a hose fitting and a removable hose, and optionally a turn off valve assembly, and/or check valve assembly, and/or a removable sealing fitting. On the interior of the holding tank, the integral wide spray nozzle is ready to direct water across and down the full length of the interior of the tank, which in turn directs all the contents of the holding tank out through the oppositely located opened drain. Preferably, in tailoring the overall installation to specific traveling trailers and motor homes, PVC pipes and fittings and/or hose fittings with hose and a valve will be installed to provide a convenient place near the edge of a vehicle frame, where the driver or other person may quickly attach a hose provided at a service station or at his or her home. Thereafter he or she will turn on the conveniently located valve at the exterior of the vehicle, and then turn on the supply of cleaning water at the gas station or home to quickly and thoroughly clean out, in a short while, the vehicle holding tank, as the water spray effectively covers and sweeps the bottom and bottom sides and end of the holding tank. When a check valve is used, allowing fresh flushing water to enter the holding tank, but blocking any outward flow of liquids, no other vehicle mounted valve is needed. If any original pipe threads are used, then a hose adapter is installed. However, the illustrated spray flushing attachment is made for direct use with standard PVC pipe fittings which are today available in hardware stores.

DESCRIPTION OF THE DRAWINGS

The preferred embodiment of the spray flushing attachment and its preferred combination with a holding tank are illustrated, in conjunction with a traveling trailer, in the drawings, wherein.

DESCRIPTION OF THE PREFERRED EMBODIMENTS

Introduction to the Spray Flushing Attachment, its Installation and Use

Although the convenient and thorough cleaning of holding tanks on traveling trailers, motor homes, and now yachts, etc., has been wanted by many persons, there are none known to the Applicant which could use essentially presently available products for fully, quickly, and conveniently cleaning out a holding tank in a routine manner each time emptying of such tanks was undertaken. However, there are now available in stores, all plastic components generally referred to as PVC pipes and fittings therefore, inclusive of line valve assemblies and other accessories for home plumbing and watering gardens. For example, there are sealing caps for ends of double outlets when only one outlet is being used. There are intermediate fittings for connecting garden hoses with hose threads to pipes with and without pipe threads. Moreover, there are diverging spray nozzles used on machines operated to clean tennis courts, walkways, gas station floors, etc., where the spray is directed out in front and down and across the surface being cleaned.

Figure 1:
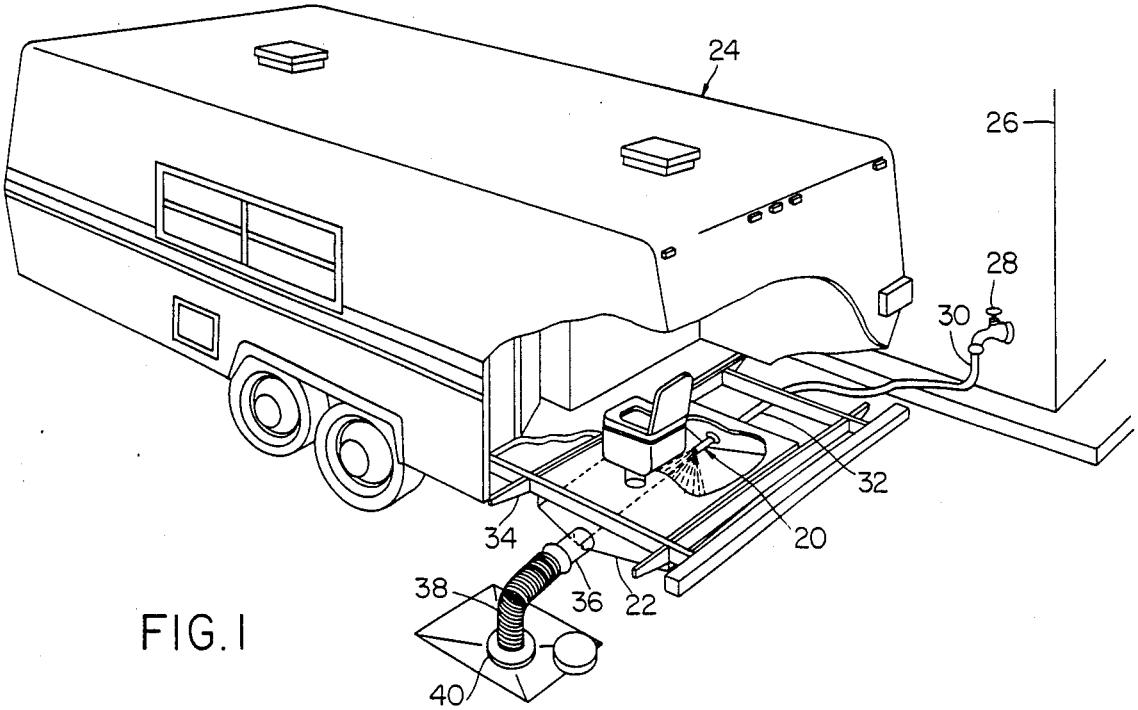
FIG. 1 is an orthographic view of a traveling trailer with portions removed to illustrate cleaning operation of a holding tank equipped with this spray flushing attachment, indicating the water source at a station and the dumping facilities thereof.
Figure 2:
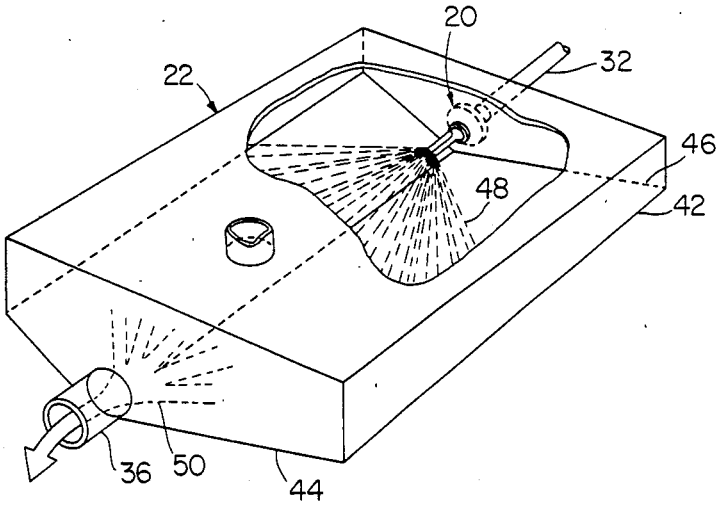
FIG. 2 is an orthographic view of a preferred holding tank and also the preferred spray flushing attachment located opposite to the drain, with the dotted lines indicating the wide spray, and with the shaded areas indicating the exiting flows out of the drain of the holding tank.
Figure 8:
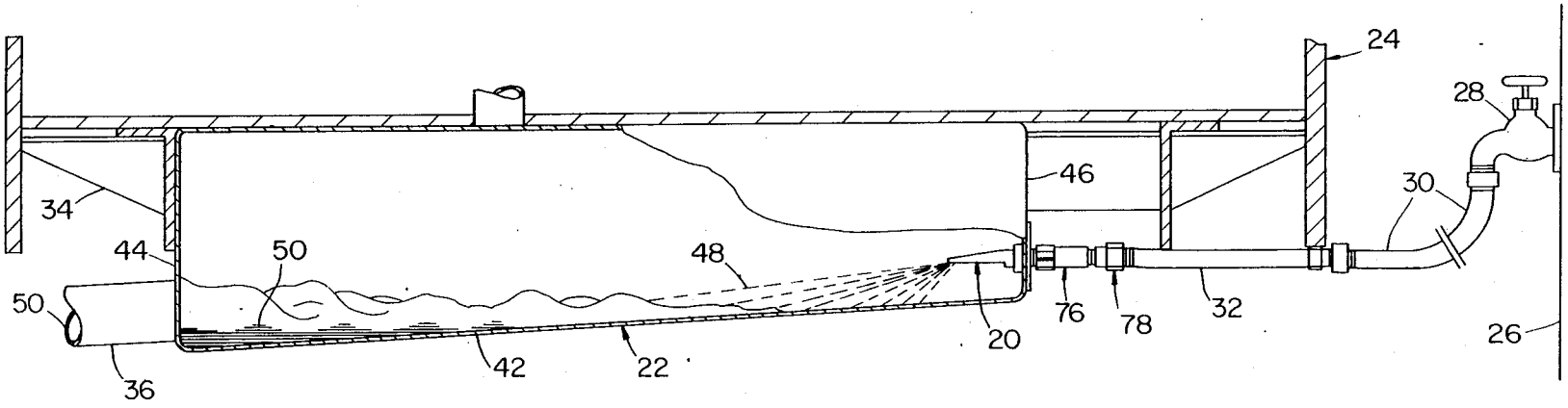
FIG. 8 is a partial transverse cross-section illustrating how the vehicle holding tank is being cleaned, indicating how the entering spray is agitating and churning the liquid-plus contents of the holding tank during the draining and cleaning of the holding tank, and also showing the installation of a check valve and a hose adapter.

Therefore, this spray flushing attachment 20 has been designed to integrally incorporate and to improve upon the spray nozzle features of such diverging spray nozzles into an integral spray flushing attachment 20 for holding tanks 22, and to thereafter, depending on the optional currently available components selected by an installer, to equip vehicles 24 having holding tanks 22 with a spray flushing attachment 20, as shown in FIGS. 1, 2 and 8, to conveniently and thoroughly clean out a holding tank 22.

As shown in FIG. 1, a traveling trailer 24 is moved into a position at a service station 26 to be supplied by water from an outlet 28, passing through a temporarily used station hose or trailer hose 30, flowing through a hose or pipe 32 mounted on the frame 34 of the traveling trailer 24, guided on into the spray flushing attachment 20. Then, as shown in FIGS. 1, 2, 3 and 8, the water leaving the spray flushing attachment 20 widely diverges to thoroughly clean out the bottom and lower sides of the interior of the holding tank 22, essentially cleaning the tank 22. The drain 36 of the tank 22 is temporarily connected to a flexible hose 38 supplied by the service station 26 or sometimes carried on the trailer 24, which in turn is connected to a receiving station inlet 40, in turn generally connected to a sewer system, not shown. Also the holding tank 22 drain valve is not shown.

Figure 3:
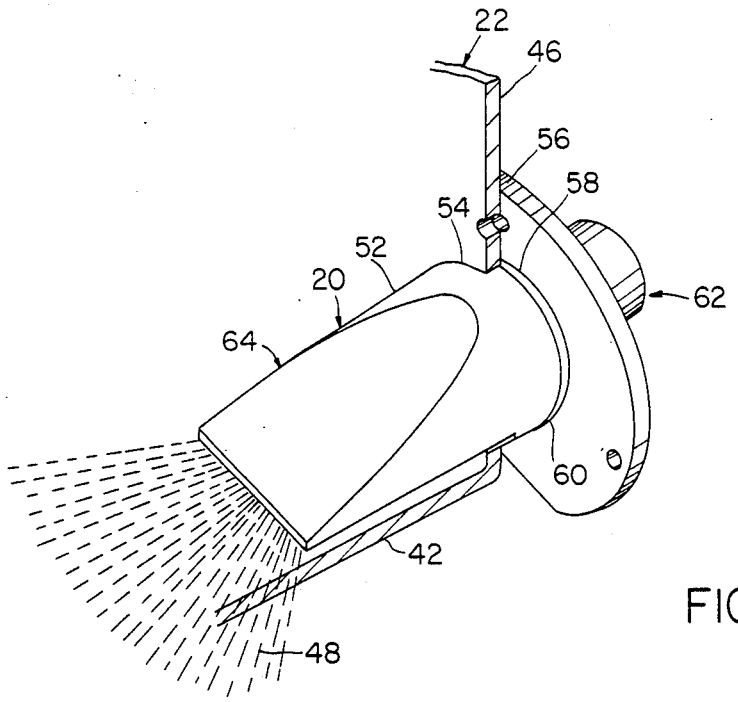
FIG. 3 is an enlarged view of the spray flushing attachment showing its integral arrangement of a spray nozzle inside the tan, a circular hollow housing fitting the tank wall, only partially shown, an outer flange equipped with an O ring seal and fastening places, and the exterior outside PVC like pipe portion to receive other PVC pipe fittings and/or hose fittings to serve as a selected valve assembly and/or removable seal, etc.
Figure 4:
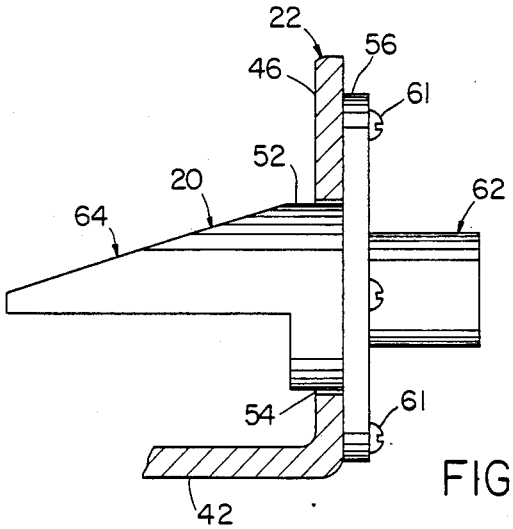
FIG. 4 is an enlarged side view of the spray flushing attachment illustrating its mounting to the holding tank wall just above the bottom of the holding tank, only partially shown.
Figure 5:
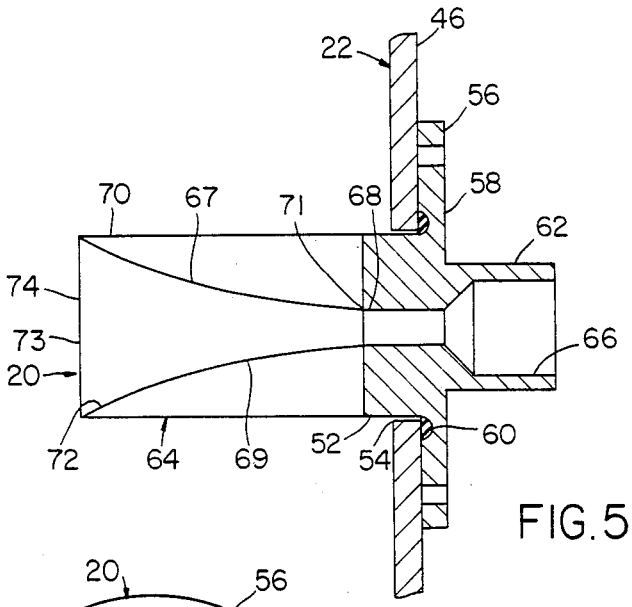
FIG. 5 is a bottom view of the spray flushing attachment secured to the holding tank wall, with portions broken away to illustrate the water flow path through the spray flushing attachment indicating how the water channel widens via its arcuate opposite sides.

Preferred Embodiment of the Placement of the Flushing Attachment to a Holding Tank As illustrated in both FIGS. 1, 2 and 3, the holding tank 22 preferably should have a bottom 42 sloping lengthwise, and also sloping transversely to the middle. Then the drain 36 should be made at the lowest point on one wall, called the rear wall 44, and the spray flushing attachment 20 should be installed just above the bottom of the opposite wall, called the front wall 46 of the holding tank 20 at the center thereof. Then when cleaning water exits the spray flushing attachment 20 in a diverging spray 48, as shown in FIGS. 1, 2, 3 and 8, the bottom of the holding tank will be cleaned and consequently the entire tank will be essentially cleaned during each routine emptying of the holding tank 22 as indicated by the flow of the discharging fluids 50 in FIG. 2.

Preferred Embodiment of the Spray Flushing Attachment

In FIGS. 3 through 7, the preferred embodiment of the spray flushing attachment 20 is shown in enlarged views, with portions of the holding tank also being illustrated in FIGS. 3, 4, 5 and 7. Preferably, plastic molding production procedures are followed to produce an integral spray flushing attachment 20. A circular hollow housing portion 52 is about the mid portion of this spray flushing attachment 20. It is accurately fitted into a hole 54 in the front wall 46 of the holding tank 22, as shown in FIGS. 3, 4, 5 and 7. The adjacent integral outside flange 56, with a recess 58 to position an O ring 60, is fastened by using screws 61, and/or adhered to the exterior of the holding tank 22 by adhesives, to thereby complete the installation of the spray flushing attachment 20. Outside of the holding tank 22, the outside or external PVC pipe like portion 62 of the spray flushing attachment 20, is positioned to receive available, selective, PVC pipe fittings available at hardware stores, and/or other plastic hose accessories, as generally shown in FIGS. 1, 2 and 8.

Figure 6:
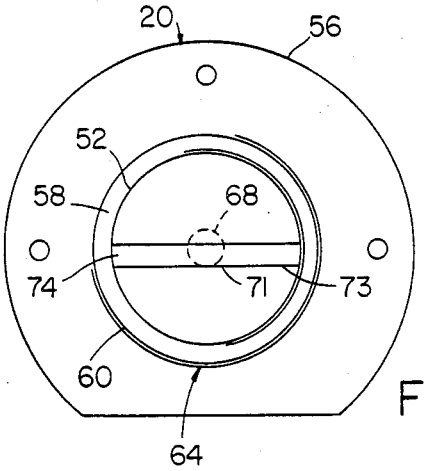
FIG. 6 is an end view of the spray flushing attachment, with respect to the spray nozzle end which is inserted into the holding tank to show how the widened nozzle portions terminate at a horizontal level which is the level of the bottom of the circular exit of the commencing nozzle portion.
Figure 7:
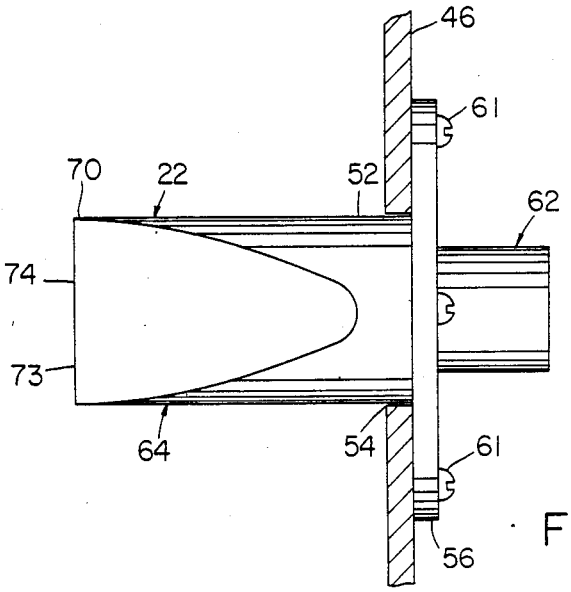
FIG. 7 is an enlarged top view of the spray flushing attachment illustrating its mounting to the the holding tank wall, only partially shown.

Inside the holding tank 22, is the integral spray nozzle portion 64, shaped somewhat like other spray nozzles which are used for example in equipment operated to clean paved surfaces. However this integral spray nozzle has been specifically formed to create a spray pattern especially useful to clean holding tanks 22. As shown in FIGS. 3 through 7, water under pressure entering the external cylindrical PCV pipe like portion 62 passes through its hollow center 66, and then through a restricted hollow center 68 of the integral circular hollow housing 52. Thereafter the water exits in a diverging spray 48, through the widening channel, formed by the arcuate diverging side surfaces 67 and 69 which is covered by sloping top structure 70 and not covered at the open bottom 72, as shown in FIGS. 3, 4, 5 and 7. As shown in FIG. 6, the sloping top structure 70 terminates in a horizontal plane, which also passes through the bottom of restricted hollow center 68 at its discharge end 71.

The circular proportions of most of the integral structure of the spray flushing attachment 20 are illustrated in FIG. 6, as they are viewed by looking toward the exit or discharge end 73 of the spray nozzle portion 64. However in contrast to the circular shapes, the top end 74 of the sloping top structure 70 of the spray nozzle portion 64 is rectangular in shape to effectively assist in guiding the diverging spray 48, so the cleaning sprayed water completely reaches across the bottom 42 and to both sides of the bottom 42 of the holding tank 22.

By conveniently installing this spray flushing attachment 20 on a holding tank 22 of a traveling trailer 24 or other vehicle, preferably opposite the drain 36, where it is at all possible to do so, as illustrated in FIGS. 1, 2 and 8, and then adding other selected commercially available components, thereafter the very adequate and convenient cleaning of a holding tank 22 is routinely undertaken via convenient, outside, and less time consuming operations. No longer is there a need to take a hose inside the traveling trailer 24, motor home, or other vehicle, to flush out a holding tank 22.

Use of Available Components in Flushing Out the Vehicle Holding Tank

In FIG. 8, a more detailed presentation is made of the flushing operation, originally illustrated in FIGS. 1, 2 and 3, where the dotted lines indicate the spraying cleaning water. In FIG. 8, the start of the draining and cleaning of a vehicle holding tank 22 is illustrated. A service station water valve 28 is opened and cleaning water is flowing through the service station garden hose 30, then through a garden hose 32 or a PVC pipe, or a galvanized pipe installed on the traveling trailer 24. An adapter 78 may be next in the flow circuit, if, for example pipe thread or hose thread portions are used at this point and continuing on to the spray flushing attachment 20, which may likewise have an adapter cemented to it to present an external threaded portion not shown. Other adapters are selectively used as conversion fittings to change over, for example from pipe threads of metal or plastic pipes to garden hose threads, etc. The spray flushing attachment 20 is formed to receive currently available PVC components.

By using such adapters with the spray flushing attachment 20, then other standard parts such as a check valve 76 may be installed in this incoming cleaning water circuit, as also illustrated in FIG. 8. When such a check valve 76 is installed to allow the entry of cleaning water, but to block the exit flow of liquid-plus contents of a holding tank 22, then no other valve is needed on the traveling trailer 24.

Figure 9:
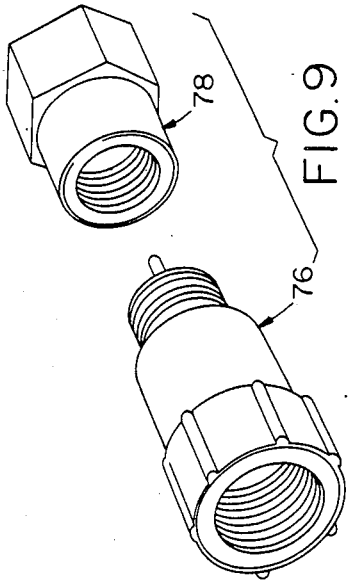
FIG. 9 is an orthographic view of the adjacent check valve and hose adapter, shown assembled together in FIG. 8, the hose adapter being used if pipe threads are originally made on the spray flushing attachment, and a garden hose is installed at this location, as shown in FIG. 8; however, as shown in earlier views, the starting unit of this spray flushing attachment is made to directly receive as many as possible of optionally selected PVC pipe fittings, which are available today for example in hardware stores.

In FIG. 9, a readily available threaded adapter 78 is shown, adjacent a readily available threaded check valve 76. These types of components of adapters and check valves are also believed to be available in non threaded components, which will be cemented together, as are many of the PVC pipes and PVC pipe components arranged to be cemented together. Such PVC pipes and accessories are so designated, for it is believed they are derived from polyvinyl chloride resins.

Regardless of the apparatus used to conduct cleaning water to the vehicle holding tank 22, the cleaning and flushing operations, centering on the use of the spray flushing attachment 20, continue on with the same overall objective of obtaining an essentially clean tank after each flushing. The cleaning water under pressure, i.e. the flushing water, is turned on when the holding tank 22 is first opened to be drained. It is not necessary to wait for the contents to be emptied before the water is turned on. It is very desirable and really necessary that the water under pressure is turned on at the time when the drain is opened. The clean sprayed water rushes in flowing essentially under the liquid-plus contents of the holding tank causing a churning action from one end of the holding tank to the other end as illustrated in FIG. 8. This spraying cleaning water flow results in thoroughly cleaning the holding tank, if the cleaning water remains turned on, until clear water is running out of the vehicle holding tank 22. Then, in reference to a second purpose of using this spray flushing unit, the drain valve is closed, as the water continues to flow into the tank for an additional short time, to add a reservoir of water. This reservoir of water is needed in the bottom of the clean tank to keep the next incoming sediment from collecting directly on the surface of the bottom of the tank.

What is claimed is:

1. A spray flushing attachment for a vehicle holding tank, comprising:

(a) fluid inlet supply means for connection to a fluid source and having a first central bore of a first diameter;

(b) an integral flange disposed about said supply means and including front and rear parallel surfaces and said flange adapted for being secured to an apertured tank wall;

(c) a second central bore in said flange coaxial with said first bore and having a diameter less than said first diameter;

(d) an integral housing portion extending axially forwardly from said front surface and having an outer diameter exceeding said first diameter;

(e) a third central bore in said housing portion coaxial with and of the same diameter of said second bore;

(f) an annular recess in said front surface disposed about said housing portion for receiving seal means;

(g) integral spray nozzle means extending forwardly from said housing portion and including a spray channel with a discharge end portion centered about said third bore and said channel defined by a pair of spaced apart diverging sidewalls and a forwardly and downwardly sloping top wall and said sidewalls terminating in a lower planar portion extending tranverse to said flange and being spaced apart at said discharge end portion a distance corresponding to the diameter of said housing portion so that pressurized fluid is sprayed downwardly and forwardly in a diverging pattern; and, (h) said discharge end portion including a rectangular end portion extending parallel to said flange and transverse to said bores for guiding the fluid.

2. The attachment of claim 1, wherein:

(a) said planar portions being coincident with the periphery of said third bore.

3. The attachment of claim 2, wherein:

(a) said planar portions being parallel and extending the length of the associated side walls.

4. The attachment of claim 1, wherein:

(a) said first bore including a forwardly extending tapered portion for restricting the flow of fluid.

5. The attachment of claim 1, wherein:

(a) a plurality of apertures being disposed about said flange for receiving means for securing said flange to the tank wall.

6. The attachment of claim 1, further comprising:

(a) an O-ring in said recess for sealing with the tank wall.

7. The attachment of claim 6, wherein:

(a) said recess having an inner diameter corresponding to the outer diameter of said housing portion.

8. The attachment of claim 1, wherein:

(a) said spray flushing attachment being comprised of plastic.

9. The attachment of claim 8, further comprising:

(a) valve means connected to said fluid inlet supply means for permitting fluid flow only to said fluid inlet supply means.

10. The attachment of claim 9, wherein:

(a) said valve means including a check valve.

11. The attachment of claim 8, wherein:

(a) said fluid inlet supply means having exterior threads for engaging said valve means.

12. A spray flushing attachment for a vehicle holding tank, comprising:

(a) a plastic inlet pipe for connection to a source of pressurized water and said pipe having a first bore with a first diameter;

(b) a plastic flange integral with and disposed about an end of said pipe and including front and rear parallel surfaces and having a second bore coaxial with said first bore and of a diameter less than the first diameter;

(c) a plastic housing portion integral with and extending forwardly from said flange and having an outer diameter exceeding said first diameter and said housing portion having a third bore coaxial with said second bore and of the same diameter thereof;

(d) an annular recess in said front surface coaxial with said housing portion and having an inner diameter substantially equal to said housing portion outer diameter for receiving an O-ring;

(e) a plastic spray nozzle extending forwardly from said housing portion and including a spray channel centered about said third bore and having a discharge end, said channel defined by a pair of spaced apart arcuate diverging side walls and a forwardly and downwardly sloping top wall and said side walls each terminating in a planar portion extending transverse to said flange and along the length of said side walls and said side walls being spaced apart at said discharge end a distance corresponding to the outer diameter of said housing portion so that pressurized water sprays downwardly and forwardly in a diverging pattern; and, (f) said discharge end including a plastic rectangular end portion extending parallel to said flange and transverse to said bores for guiding the water.

13. The attachment of claim 12, wherein:

(a) said planar portions extending along a plane tangent to the periphery of said third bore.

14. The attachment of claim 13, wherein:

(a) means being associated with said flange for securing said flange to a tank wall.

15. The attachment of claim 14, wherein:

(a) said first bore including a forwardly extending tapered portion for reducing the water flow.

16. The attachment of claim 15, wherein:

(a) a check valve being mounted to said pipe upstream thereof for permitting water flow only to said first bore.

17. The attachment of claim 12, further comprising:

(a) an O-ring positioned in said recess.

18. A flushable vehicle holding tank, comprising:

(a) first, second, third and fourth interconnected side walls, said first and third side walls being disposed in parallel transverse to said parallel second and fourth side walls, said side walls having a coincident top edge and said second and fourth side walls have aligned bottom edges and said first and third side walls having aligned first and second converging bottom edges;

(b) a bottom wall secured to said bottom edges and defining a trough extending between said first and third side walls and being defined by said converging bottom edges;

(c) a top wall secured to said top edges for thereby providing a holding tank;

(d) a drain opening in said first side wall aligned with said trough;

(e) an attachment opening in said third side wall above said bottom and opposite to said drain opening;

(f) a flushing attachment positioned in said attachment opening and comprising:

(g) a flange disposed about said attachment opening and being secured to and sealed with said third side wall and having a central bore of a first diameter;

(h) fluid inlet supply means extending exteriorly from said flange and having a bore coaxial with said central bore and of a diameter exceeding said first diameter;

(i) a housing portion integral with said flange and extending through said attachment opening into said holding tank and having a diameter substantially equal to said attachment opening diameter and said housing portion having a bore coaxial with said central bore and of the same diameter;

(j) a spray nozzle means extending forwardly from said housing portion into said tank and including a spray channel with a discharge end and said channel centered about said housing portion bore and defined by a pair of spaced apart diverging side walls and a forwardly and downwardly sloping top wall and said side walls terminating in a lower planar portion extending transverse to said flange and being spaced apart at said discharge end portion a distance equal to said housing portion diameter so that pressurized fluid is sprayed downwardly and forwardly in a diverging pattern across and along the length of said bottom wall for flushing clean said holding tank and for exiting through said drain opening; and, (k) said discharge end portion including a rectangular end portion extending parallel to said flange and transverse to said bores for guiding the fluid during spraying.

19. The tank of claim 18, wherein:

(a) said flange having an annular recess adjacent said third wall; and, (b) an O-ring positioned in said recess for sealing said flange to said side wall.

20. The tank of claim 18, wherein:

(a) valve means being connected to said drain opening; and, (b) check valve means being connected to said fluid inlet supply means.

* * * * *